US006768264B2

(12) United States Patent
Beech et al.

(10) Patent No.: US 6,768,264 B2
(45) **Date of Patent: *Jul. 27, 2004**

(54) SHORT ARC LAMP WITH IMPROVED THERMAL TRANSFER CHARACTERISTICS

(76) Inventors: Paul L. Beech, 7 Waterside La., W. Newbury, MA (US) 01985; Albert M. DeDonato, 26 Glendale Ave., Peabody, MA (US) 01960

( * ) Notice: Subject to any disclaimer, the term of this patent is extended or adjusted under 35 U.S.C. 154(b) by 0 days.

This patent is subject to a terminal disclaimer.

(21) Appl. No.: 10/656,988

(22) Filed: Sep. 5, 2003

(65) Prior Publication Data

US 2004/0051455 A1 Mar. 18, 2004

Related U.S. Application Data

(63) Continuation of application No. 09/995,453, filed on Nov. 27, 2001, now Pat. No. 6,670,758.

(51) Int. Cl.[7] ..... H01J 61/30

(52) U.S. Cl. ..... 313/634; 313/623; 313/636; 313/110; 313/113; 313/246; 313/284; 313/285

(58) Field of Search ..... 313/634, 636, 313/285, 110–113, 623, 246, 284; 362/166, 264, 262

(56) References Cited

U.S. PATENT DOCUMENTS

| | | | | |
|---|---|---|---|---|
| 3,731,133 | A | 5/1973 | McRae et al. | 313/113 |
| 4,599,540 | A | 7/1986 | Roberts | 313/570 |
| 4,633,128 | A | 12/1986 | Roberts et al. | 313/113 |
| 5,327,049 | A | 7/1994 | Smolka et al. | 315/248 |
| 5,399,931 | A | 3/1995 | Roberts | 313/46 |
| 5,789,863 | A | 8/1998 | Takahashi et al. | 313/623 |
| 5,861,715 | A | 1/1999 | Igarashi et al. | 313/635 |
| 5,903,088 | A | 5/1999 | Sugitani et al. | 313/46 |
| 5,961,203 | A | 10/1999 | Schuda | 362/294 |
| 6,114,807 | A | 9/2000 | Kavanagh | 313/570 |
| 6,179,446 | B1 | 1/2001 | Sarmadi | 362/264 |
| 6,200,005 | B1 | 3/2001 | Roberts et al. | 362/263 |
| 6,281,629 | B1 | 8/2001 | Tanaka et al. | 313/631 |
| 6,285,131 | B1 | 9/2001 | Kiss et al. | 313/634 |
| 6,341,876 | B1 | 1/2002 | Moss et al. | 362/268 |
| 6,400,067 | B1 * | 6/2002 | Manning et al. | 313/46 |
| 2003/0098652 | A1 | 5/2003 | Beech et al. | 313/634 |

* cited by examiner

*Primary Examiner*—Ashok Patel
*Assistant Examiner*—Sikha Roy
(74) *Attorney, Agent, or Firm*—Barlow, Josephs & Holmes, Ltd.

(57) ABSTRACT

A short arc lamp is optimized for improved thermal performance characteristics. The short arc lamp includes a ceramic body having a concave reflective surface formed in an upper end thereof, a base adapted to receive the base end of the ceramic body in abutting relation, and a window frame assembly positioned in abutting concentric relation with the upper end of the ceramic body. In particular, the ceramic body is formed from beryllia (beryllium oxide) which has superior thermal transfer characteristics. The lamp is further provided with a specialized coating which help keep infrared (IR) light energy from escaping from the lamp. In one instance, the coating is an IR reflective coating placed on the window of the lamp to reflect IR light energy back into the lamp where it can be conducted outwardly through the beryllium oxide body and base. In another instance, the reflector surface of the beryllium oxide body is provided with a dichroic coating which reflects visible light, while allowing IR energy to pass through. Accordingly, the IR energy passes through to the ceramic body and is transferred outwardly through the base.

1 Claim, 10 Drawing Sheets

SHORT ARC LAMP WITH IMPROVED THERMAL TRANSFER CHARACTERISTICS

CROSS-REFERENCE TO RELATED APPLICATIONS

This application is a continuation of and claims priority from U.S. patent application Ser. No. 09/995,453, filed Nov. 27, 2001, now issued as U.S. Pat. No. 6,670,758 which is incorporated herein by reference.

BACKGROUND OF THE INVENTION

The instant invention relates to short arc lamps, and more specifically to a short arc lamp having an improved housing structure which simplifies manufacturing and reduces cost, while also improving structural integrity and thermal performance.

Short arc inert gas lamps are well known in the prior art for use in applications requiring high intensity light, such as for example, in spectroscopy, or in other fiber optics illumination devices, such as endoscopes for the medical industry. Short arc lamps generally comprise a sealed chamber containing an inert gas, such as xenon, pressurized to several atmospheres, and an opposed anode and cathode defining an arc gap. The application of electricity to the anode and cathode cause an arc which glows brightly in the inert gas. A reflective surface within the chamber reflects light outwardly through a window. While the general configuration of these lamps is well known there are many different variations in the specific implementation. The variations are due to two significant issues that are paramount in the design and construction of such a lamp. The first issue is structural integrity of the housing to maintain the inert gas at elevated pressures and the second issue is heat transfer. Short arc lamps of this type operate at extremely high temperatures. Accordingly, there are many design issues in attempting to maintain structural integrity and also dissipate heat from the overall housing.

Throughout the prior art there have been many attempts to modify and improve both the structural integrity of the housing and to improve the thermal performance. In this regard, the US Patents to McRae et al U.S. Pat. No. 3,731,133; Roberts et al, U.S. Pat. No. 4,599,540; Roberts et al, U.S. Pat. No. 4,633,128; Roberts, U.S. Pat. No. 5,399,931; Takahashi et al U.S. Pat. No. 5,789863; Sugitani et al, U.S. Pat. No. 5,903,088; Tanaka et al, U.S. Pat. No. 6,281,629 and Kiss et al U.S. Pat. No. 6,285,131 represent the closest art to the subject invention of which the Applicant's are aware.

Each of the patents listed hereinabove describes a short arc lamp comprising a ceramic body structure having a concave reflective surface, a conductive base structure supporting the anode, and a conductive window assembly supporting the cathode. The US Patent to McRae et al U.S. Pat. No. 3,731,133 is directed to a short arc lamp wherein the reflector surface of the ceramic body is metalized to provide the reflective surface. The US Patent to Roberts et al, U.S. Pat. No. 4,599,540 discloses a short arc lamp wherein the reflector surface of the ceramic body is formed by pressing the ceramic body, when hot, with an unpolished mandrel for greater accuracy in formation of the reflective surface configuration. The US Patent to Roberts et al, U.S. Pat. No. 4,633,128 concerns another embodiment of a short arc lamp wherein the ceramic reflector body is provided with a convex space behind the reflector surface so that the reflecting wall is relatively thin near the focal point of the lamp. A copper sleeve is attached to the reflecting wall within the convex space to conduct heat away from the reflecting wall. The US Patent to Roberts, U.S. Pat. No. 5,399,931 is a further improvement to the Roberts '128 patent wherein a copper heat transfer pad is brazed to a base assembly and to an exterior ring such that heat is more efficiently transferred to the outside surfaces of the lamp. The US Patent to Takahashi et al U.S. Pat. No. 5,789,863 is directed to a short arc lamp having a single cantilevered cathode support arm which is intended to reduce thermal influences in positioning of the tip of the cathode. The US Patent to Sugitani et al, U.S. Pat. No. 5,903,088 discloses a short arc lamp wherein a gap is provided between a cathode support ring and an exterior conductive ring, and another gap is formed between a window support ring and the cathode support ring. The US Patent to Tanaka et al, U.S. Pat. No. 6,281,629 concerns a short arc lamp structure wherein a heat transfer plate is positioned between the base and the ceramic body. The heat transfer plate has a higher thermal conductivity than the base. Finally, the US Patent to Kiss et al U.S. Pat. No. 6,285,131 is directed to an arc lamp wherein the cathode suspension system is stamped from a sheet of Kovar® (Kovar® is a registered trademark of Westinghouse Electric) material and then brazed to an annular support ring.

While each of the above-noted devices is suitable and effective for the intended purpose, they are generally complex in construction and difficult to fabricate, and thus expensive to manufacture. There is thus a need in the art for an improved short arc lamp that concurrently simplifies construction while improving structural integrity and thermal performance.

BRIEF SUMMARY OF THE INVENTION

The instant invention provides such a novel short arc lamp having an improved housing structure which simplifies manufacturing and reduces cost, while also improving structural integrity and thermal performance.

The improved housing structure for a short arc lamp includes a ceramic body having a concave reflective surface formed in an upper end thereof, a base adapted to receive the base end of the ceramic body in abutting relation, and a window frame assembly positioned in abutting concentric relation with the upper end of the ceramic body.

The ceramic body comprises a cylindrical mass of alumina having a first end in which a concave reflector surface is formed. The reflector surface has an axis of rotation and a focal region defined along the axis of rotation.

The base is integrally formed with a shoulder ring adapted to receive and seal the base end of the ceramic body. Integrated formation of the shoulder ring with the base has been found to provide a significant improvement in manufacturing, as the base, ceramic body, anode, exhaust tubulation and window frame ring can be easily assembled and brazed in a single brazing operation. In particular, the base is preferably formed from an iron alloy and more preferably formed from an alloy of iron, nickel and cobalt using a metal injection molding (MIM) metallurgical forming process. MIM provides the ability to mold complex geometries in a solid part that would not be feasible in conventional milling operations or may not be cost effective.

The window frame structure is integrally formed to include an annular flange having a substantially U-shaped cross-section and three circumferentially spaced cathode support arms extending radially inwardly therefrom. The cathode support arms further include an integrally formed cathode mounting ring at the terminal intersection thereof. The window frame structure is also preferably formed using MIM forming techniques so that the window frame and cathode support arms are formed as a single unitary structure. Forming the cathode support arms as an integral portion of the frame eliminates at least one brazing step from the prior art techniques and further eliminates the separate manufacturing step of forming the cathode support arms. In the prior art, the cathode support arms were formed separately and then brazed together with the annular flange of the window frame. Axial alignment and position of the cathode support arms was difficult and time consuming in the manufacturing process. Integrally forming the annular flange, cathode support arms and the cathode mounting ring improves the accuracy of axial alignment of the cathode. In the assembly process, a sapphire window and a cathode are assembled together with the window frame structure, and brazed together in a single process to provide a completed window frame sub-assembly.

As indicated above, the novel changes in construction of the components significantly simplifies the assembly process. In the preferred method of assembly, the anode, exhaust tubulation, ceramic body and window frame ring are assembled with the base and simultaneously brazed together in a single operation to form a body subassembly.

The window frame sub-assembly is then joined to the window frame ring of the body sub-assembly to complete the assembly.

The present short arc lamp is also optimized for thermal performance in another alternative embodiment. In this alternative embodiment, the ceramic body is formed from beryllia (beryllium oxide) which has superior thermal transfer characteristics. The alternative embodiment is further provided with a coating which helps keep infra-red (IR) light energy from escaping from the window of the lamp. In one instance, the coating is an IR reflective coating placed on the window of the lamp to reflect IR light energy back into the lamp where it can be conducted outwardly through the base. In another instance, the reflector surface is provided with a dichroic coating which reflects visible light, while allowing IR energy to pass through. Accordingly, the IR energy passes through to the ceramic body and is transferred outwardly through the base. In yet another instance, the wavelength selective coatings are applied to both the reflector surface and the window.

Accordingly, among the objects of the instant invention are: the provision of an improved short arc lamp having a simplified construction of the window support, the base assembly and the body; the provision of a window support of a single piece construction that supports the cathode, supports the window, provides thermal conduction of the cathode and provides electrical conduction to the cathode; the provision of a base assembly that can be sealed to the anode, the reflector body, and to the exhaust tubulation in a single brazing operation; the provision of a base that increases the surface area of the base without altering the current footprint and that also increases thermal conduction to the external surface; the provision of an improved short arc lamp wherein the ceramic reflector body is fabricated from beryllium oxide to improve thermal conduction of heat from the lamp to the external surfaces; and the provision of an improved short arc lamp wherein the window is provided with an infrared coating to reflect IR energy back into the lamp, or the reflector surface is provided with a dichroic IR pass-through coating, or both.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
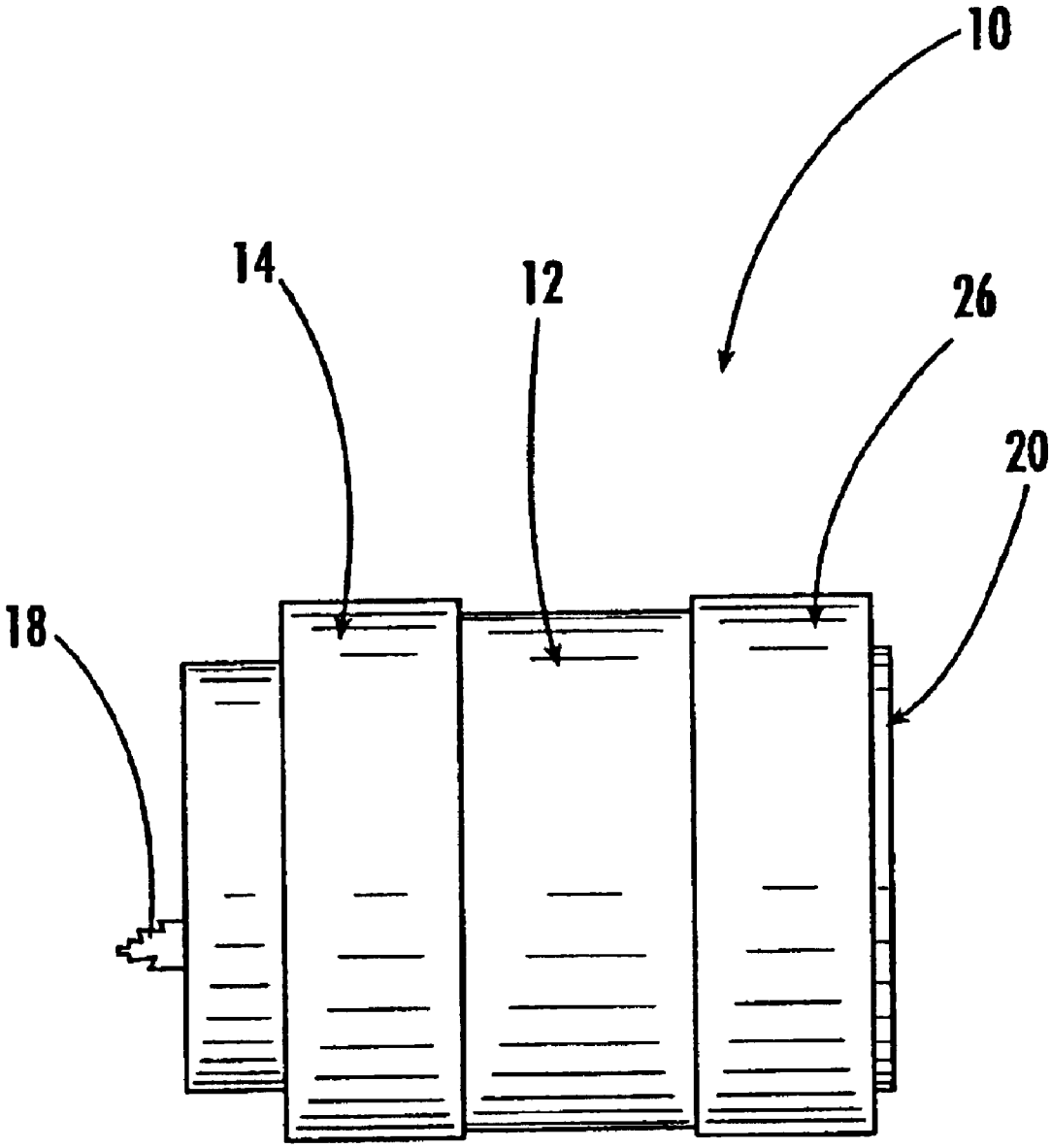
FIG. 1 is a side view of the short arc lamp of the present invention.
Figure 2:
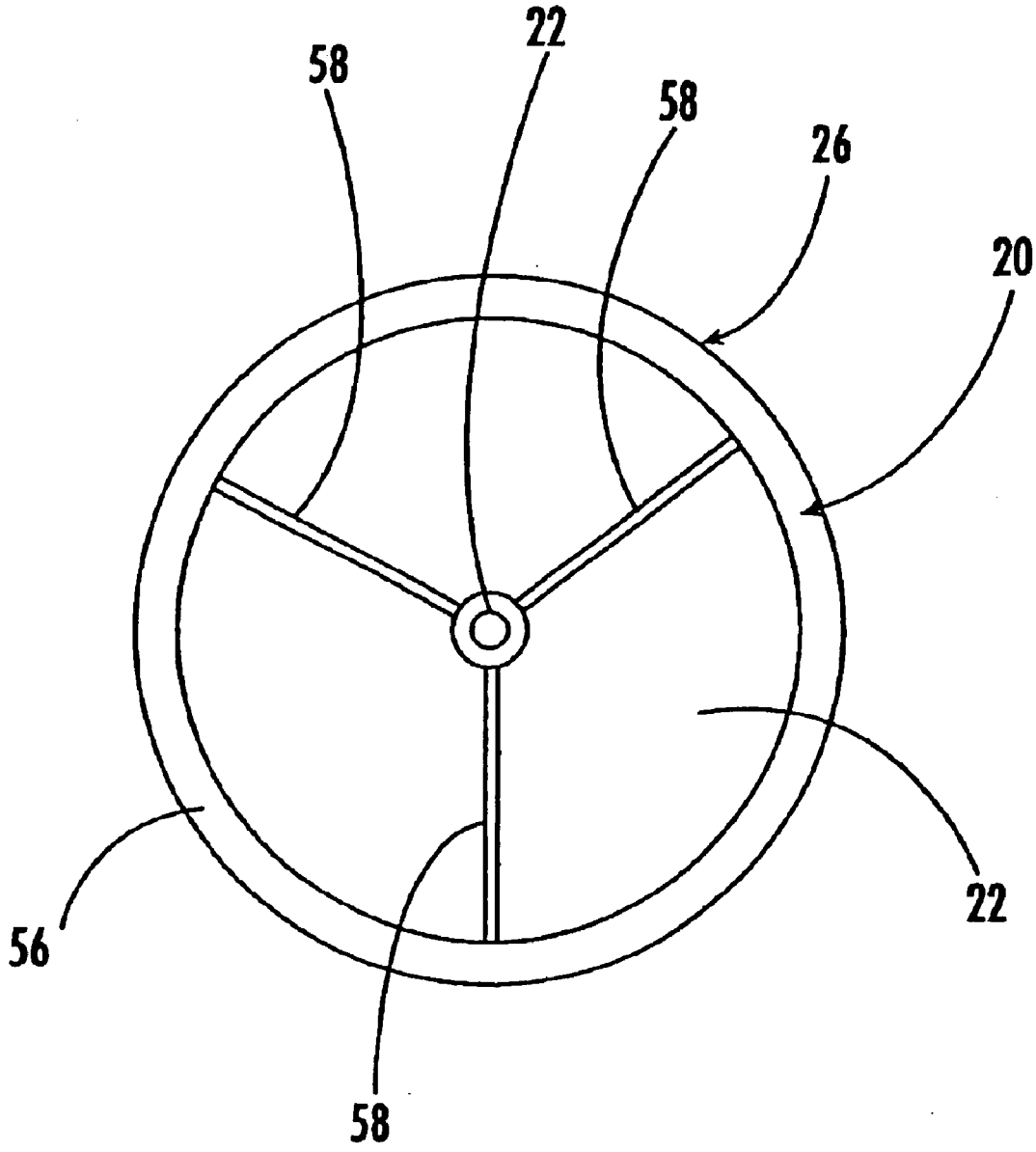
FIG. 2 is a front view thereof.
Figure 3:
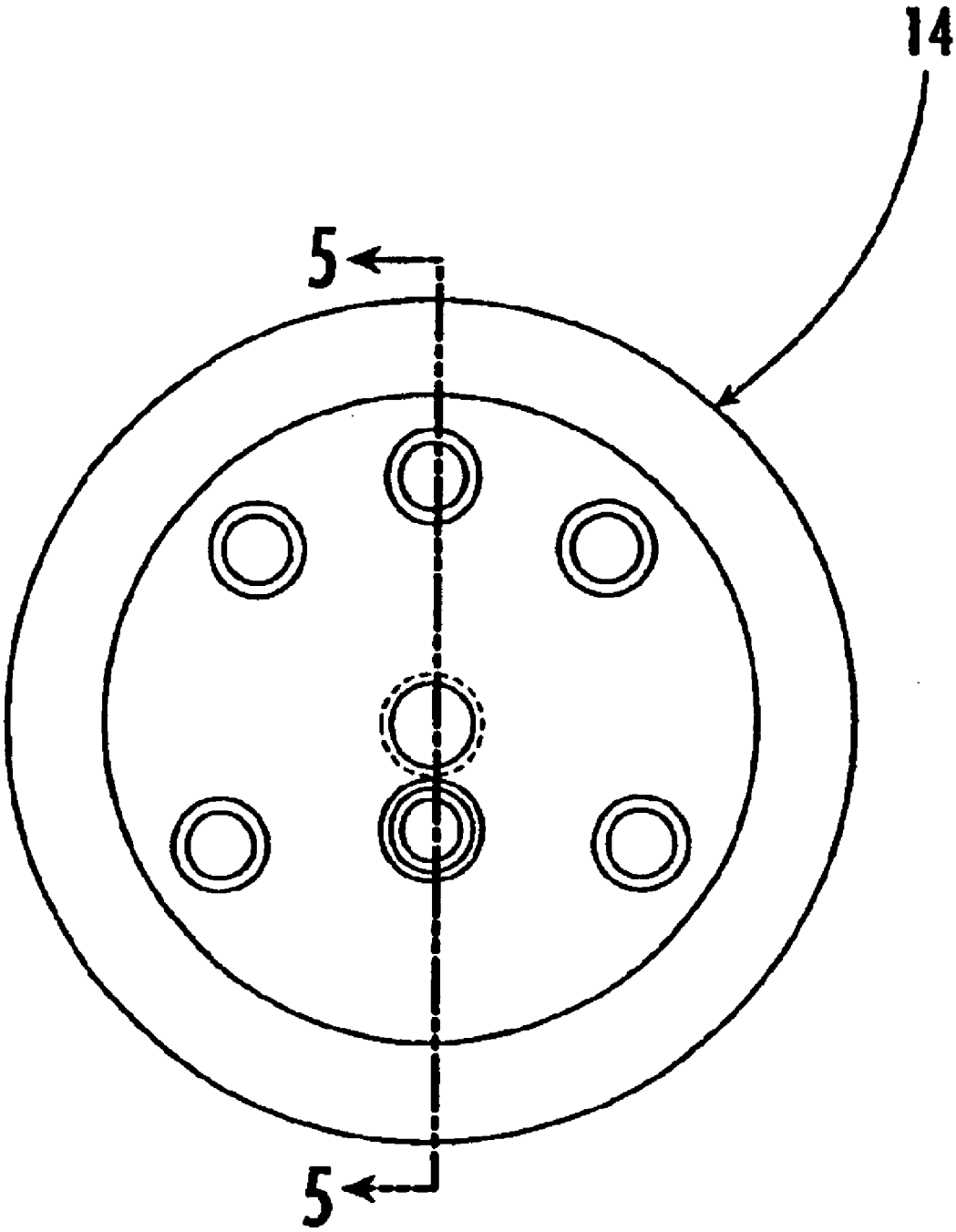
FIG. 3 is a rear view thereof.

Referring now to the drawings, the short arc lamp of the instant invention is illustrated and generally indicated at 10 in FIGS. 1–5. As will hereinafter be more fully described, the instant invention provides a novel short arc lamp having a simplified and improved housing structure which simplifies manufacturing and reduces cost, while also improving structural integrity and thermal performance.

Referring now to FIGS. 1–5, the improved short arc lamp 10 comprises a cylindrical ceramic body generally indicated at 12, a base generally indicated at 14, an anode 16, an exhaust tubulation 18, and a window frame generally indicated 20, a cathode 22, a sapphire window 24 and a window frame ring 26.

The ceramic body 12 comprises a cylindrical mass of alumina having a main body portion 28, the main body portion 28 having a first end in which a concave reflector surface 30 is formed. Alumina is a well known ceramic, electrically insulating material which is available from a variety of different commercial sources. Alumina has been extensively used in prior art arc lamps due to its relatively low cost, and high temperature characteristics.

Figure 5:
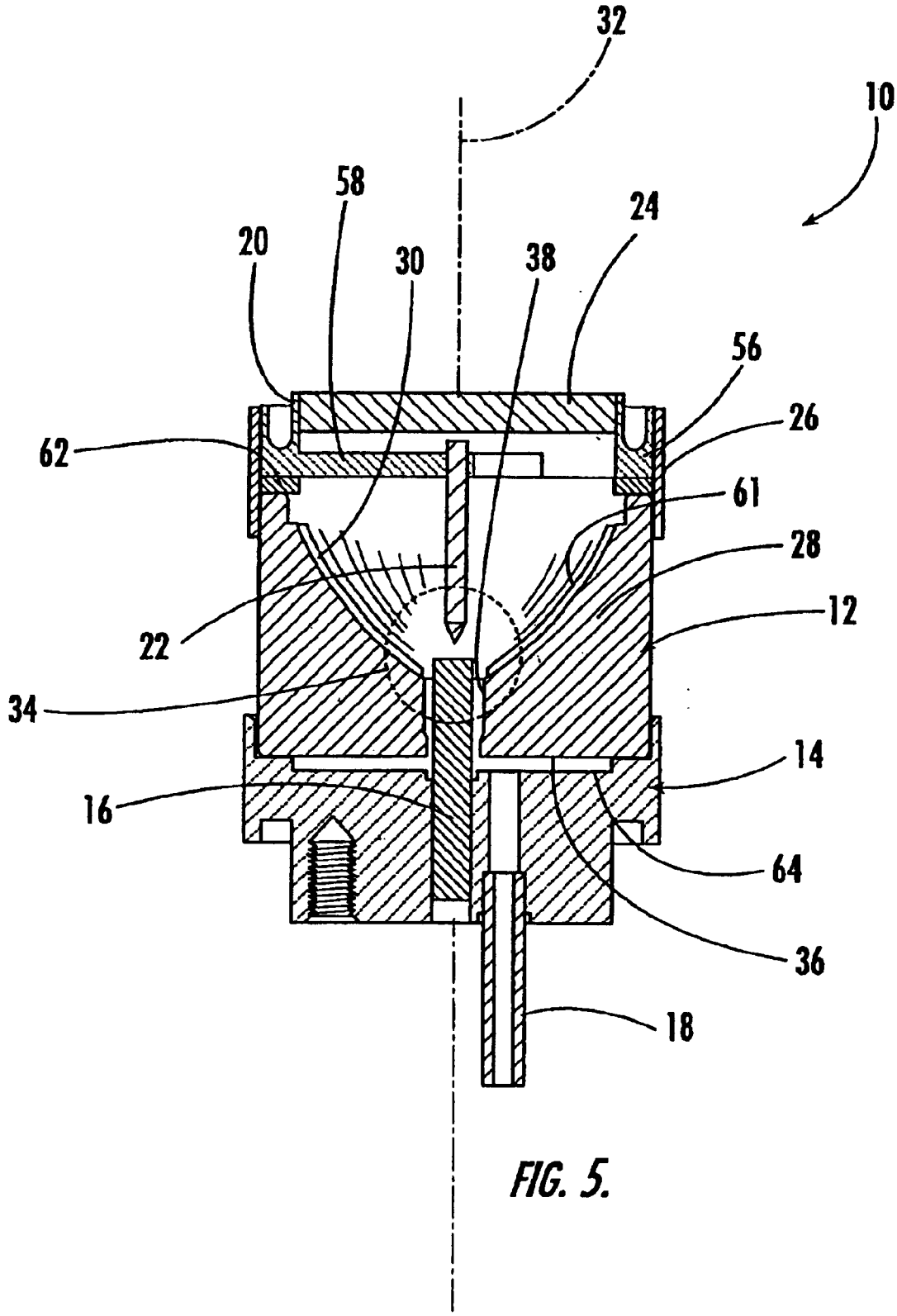
FIG. 5 is a cross-sectional view of the entire short arc lamp taken along line 5—5 of FIG. 3.

Referring to FIG. 5, the reflector surface 30 may be elliptical or parabolic, as is well known in the optical arts and has an axis of rotation 32 (shown in broken line) and a focal region 34 (shown in broken line) defined along the axis of rotation 32. The ceramic body further includes a second end 36 which is adapted to be received in mating relation with the base 14. The second end 36 of the body 12 further includes an axial opening 38 which receives the anode 16 when the base 14 is assembled with the body 12.

Figure 4:
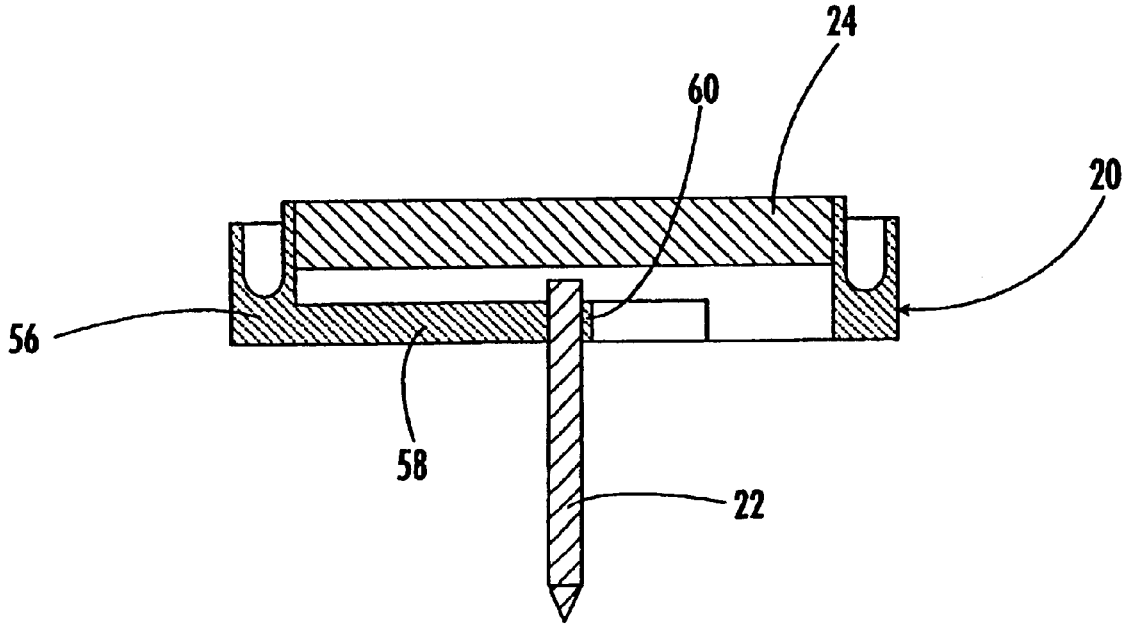
FIG. 4 is a cross-sectional view of the window frame assembly taken along line 4—4 of FIG. 1.
Figure 4A:
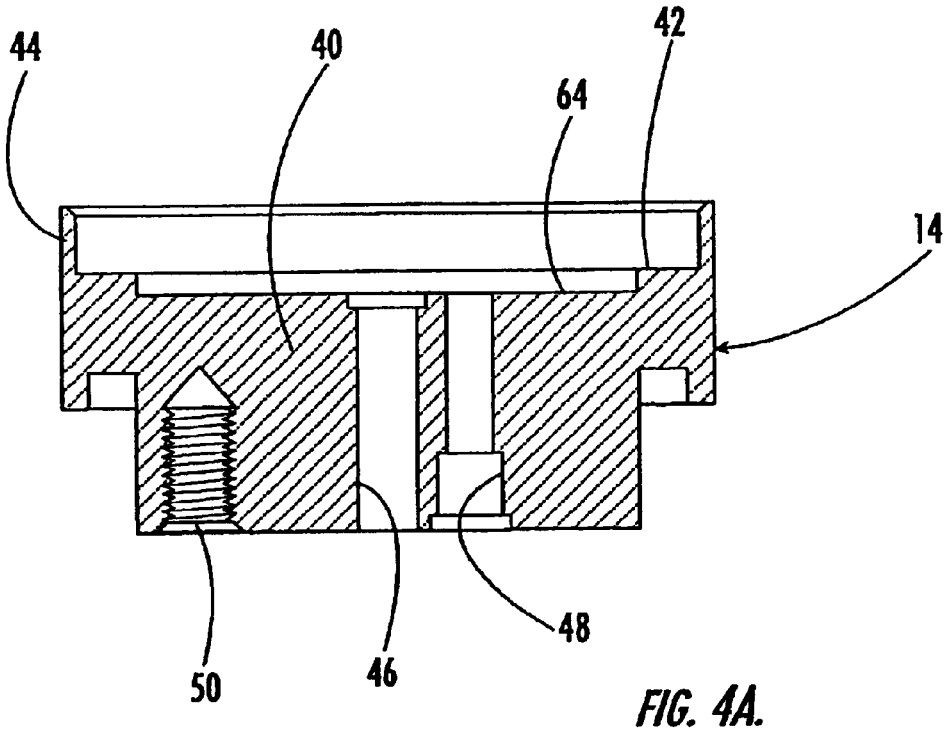
FIG. 4A is a cross-sectional view of the base taken along line 4A—4A of FIG. 1.

Referring back to FIG. 4A, the base 14 is a unitary solid mass preferably formed from an iron alloy, and more preferably an alloy of iron, nickel and cobalt. The base 14 comprises a main body portion 40 having a first end 42 which is adapted to be received in mating relation with the second (or bottom) end 36 of the body 12. The first end 42 of the main body portion 40 includes an integrally formed shoulder ring 44 extending upwardly from the peripheral edge of the main body portion 40. The integrated shoulder ring 44 is adapted to receive the base end 36 of the ceramic body 12 in mating relation. The anode 16 is received in an axial opening 46 that passes entirely through the thickness of the base 14. The exhaust tubulation is received in a separate longitudinal opening 48, extending parallel to the anode opening, that also passes entirely through the thickness of the base. Integrated formation of the shoulder ring 44 with the base 14 has been found to provide a significant improvement in manufacturing, as the base 14, ceramic body 12, anode 16, exhaust tubulation 18 and window frame ring 26 can be easily assembled and brazed in a single brazing operation. The base 14 is also provided with threaded bores 50 for attachment of the lamp assembly to external heat sink structures and electrical contacts.

Figure 7:
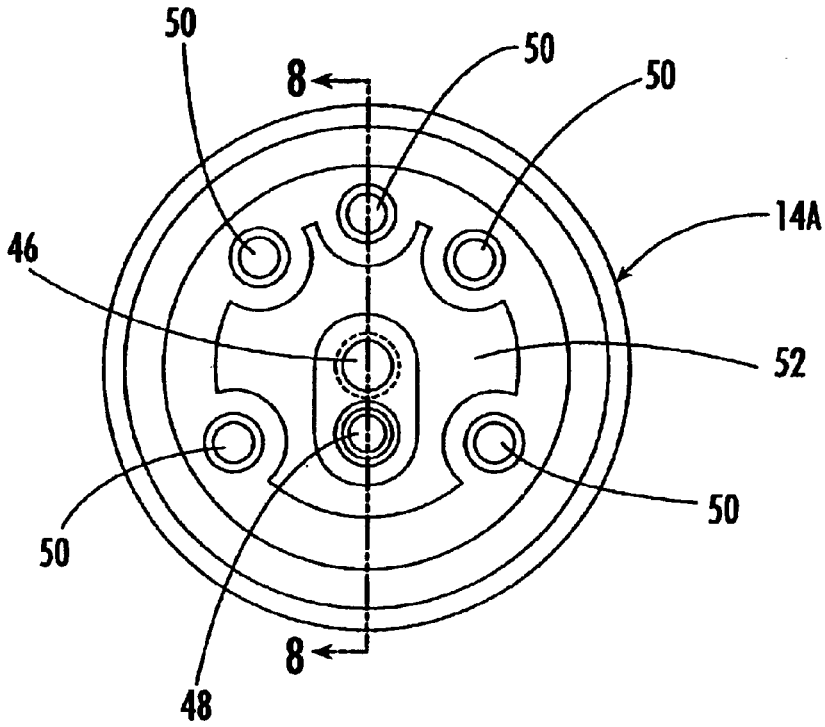
FIG. 7 is a bottom view of a first alternative embodiment of the base showing a recessed cavity.
Figure 8:
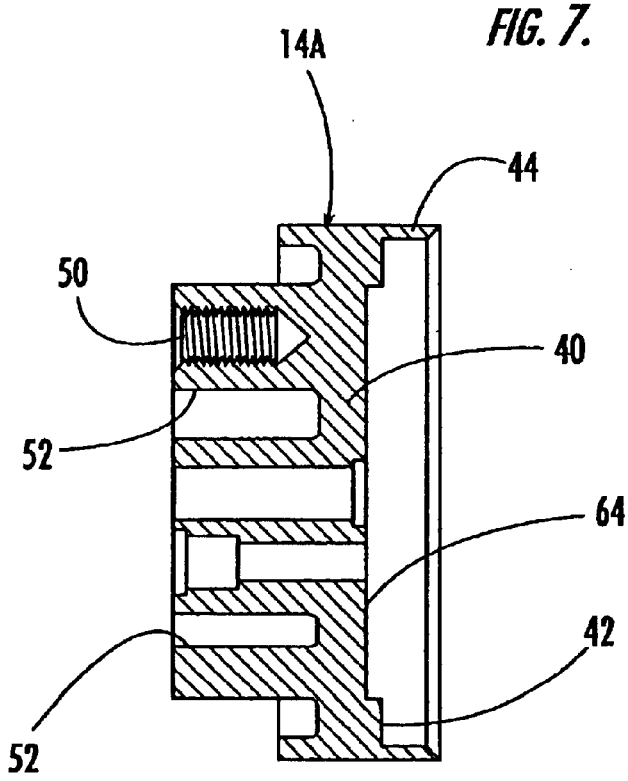
FIG. 8 is a cross-sectional view thereof as taken along line 8—8 of FIG. 7.
Figure 9:
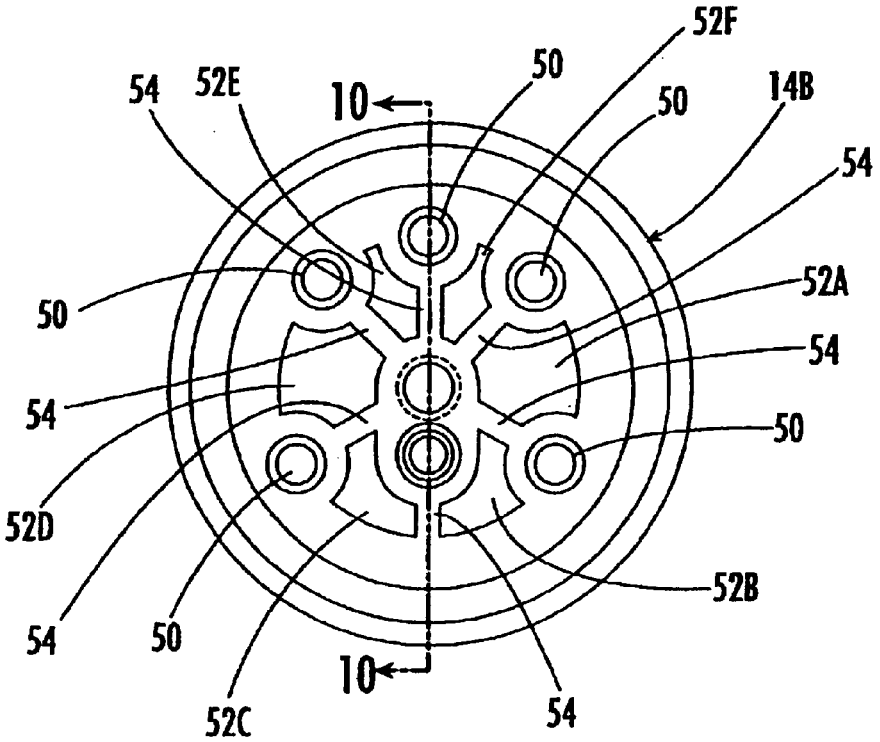
FIG. 9 is a bottom view of a second alternative embodiment of the base showing a plurality of smaller recessed cavities separated by webs.
Figure 10:
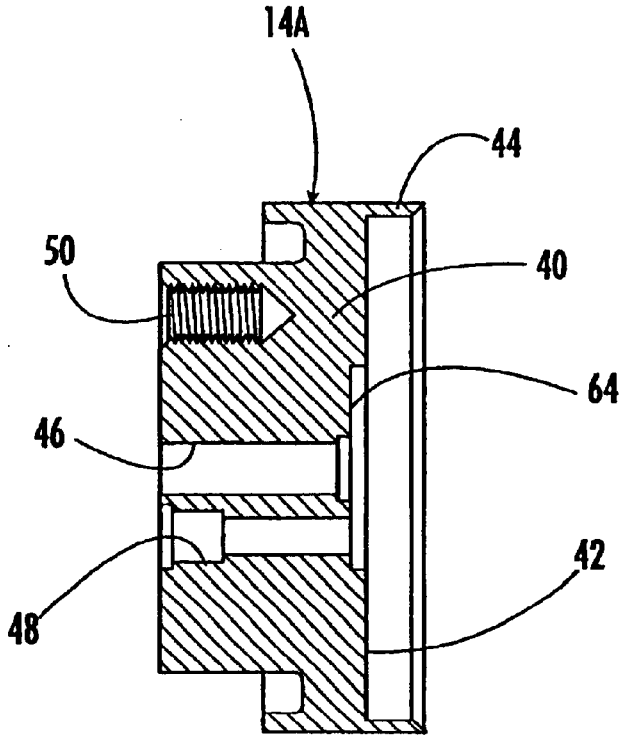
FIG. 10 is a cross-sectional view thereof as taken along line 10—10 of FIG. 9.

Formation of the base 14 by alternative forming techniques was a primary concern in development of the present invention. In this regard, the base 14 is preferably formed using a metal injection molding (MIM) metallurgical forming process. MIM is the preferred method of manufacture since MIM provides the ability to mold complex geometries in a solid part that would not be feasible in conventional milling operations. Other methods of forming the base, including conventional milling are technically possible, although more difficult. Notwithstanding, if the base 14 is to be formed using a MIM process, it is desirable to reduce the amount of mass and thicker portions whenever possible. Material cost and part shrinkage can be minimized and optimized. Accordingly, it is preferable that the base have recessed areas in and around the threaded bores 50 and the anode and exhaust tubulation openings 46 and 48 to reduce the wall thicknesses. Referring to FIGS. 7 and 8, one alternate embodiment of the base 14A is shown wherein the base 14A is provided with a single continuous recessed area 52 extending circumferentially around the central opening 46 and threaded bores 50. This embodiment removes a significant amount of mass, which however, tends, in turn, to reduce the thermal efficiency of the base 14 in conducting heat. Less mass in the base 14 translates into less mass to absorb and conduct heat. Accordingly, turning to FIGS. 9 and 10, there is shown yet another embodiment 14B where the central recessed area 52 surrounding the anode opening 46 is connected with the other peripheral edges of the base by a plurality of radial webs 54 which split the recessed area into a plurality of discrete areas 52A–52F. This arrangement adds additional mass back to the base 14 for optimal heat transfer, while also maintaining the desired wall thickness as discussed above for optimal results in the MIM forming processes.

Turning back to FIGS. 4 and 5, the window frame 20 is a unitary solid mass formed from an alloy of iron, nickel and cobalt. The window frame 20 includes an annular flange 56 having a substantially U-shaped cross-section and three circumferentially spaced cathode support arms 58 extending radially inwardly therefrom. The cathode support arms 58 further include an integrally formed cathode mounting ring 60 at the terminal intersection thereof. When the window frame 20 is assembled with the body 12, the cathode mounting ring 60 is positioned along the axis of rotation 32 of the reflector surface 30 so that the cathode 22 is axially aligned with the anode 16 along the axis of rotation 32 of the reflector surface 30. The window frame 20 is also preferably formed using MIM forming techniques so that the window frame 20 and cathode support arms 58 are formed as a single unitary structure. Forming the cathode support arms 58 as an integral portion of the window frame 20 eliminates at least one brazing step from the prior art techniques and further eliminates the separate manufacturing step of forming the cathode support arms. In the prior art, the cathode support arms were formed separately and then brazed together with the annular flange of the window frame. Axial alignment and positioning of the cathode support arms was difficult and time consuming in the manufacturing process. Integrally forming the annular flange 56, cathode support arms 58 and the cathode mounting ring 60 improves the accuracy of axial alignment of the cathode 22.

The anode 16 and cathode 22 are of conventional construction and formed from tungsten as is known in the art. The exhaust tubulation 18 and sapphire window 24 are also of conventional constructions, the details of which are well known in the art.

As indicated above, the novel changes in construction of the components of the present lamp 10 simplifies the assembly process, and in this regard simplification of assembly and processing is also considered to be a significant improvement. In the preferred method of assembly, the anode 16, exhaust tubulation 18, ceramic body 12 and window frame ring 26 are assembled with the base 14 and simultaneously brazed together in a single operation to form a base/body sub-assembly. When assembled with the ceramic body 12, the anode 16 passes through the axial anode opening 38 in the ceramic body 12. The exhaust tubulation 18 is received in longitudinal opening 48.

After brazing of the base/base sub-assembly, the reflector surface 30 of the body 12 may be coated with a reflective coating 49 as desired for the particular lamp end use. In the preferred embodiment as described, the coating 61 is a mirrored reflective coating that reflects all wavelengths of light outwardly through the sapphire window. Alternative reflective coatings are also possible.

In a separate assembly, the sapphire window 24 and a cathode 22 are assembled together with the window frame structure 20, and brazed together in a single process to provide a completed window frame sub-assembly. Alternately, the cathode 22 would be brazed first, at a higher temperature, and then the sapphire window 24 would be brazed at a lower temperature. However, it is possible to complete this assembly in a single process.

The window frame sub-assembly is then seated within the window frame ring of the base/body sub-assembly and welded to the window frame ring to complete the assembly. Shim rings 62 can be inserted under the annular flange 56 to sit on top of the rim of the ceramic body 12 to provide fine adjustment of the anode/cathode arc gap. It is noted that once the reflective coating is formed on the reflector surface 30, the assembly can no longer be brazed because the reflective coating cannot withstand the high brazing temperatures, and thus welding is the preferred method of attaching the window frame to the window frame ring.

After mechanical assembly is completed, a vacuum is applied through the exhaust tubulation 18 to evacuate the interior chamber of the lamp 10. In this regard, the exhaust tubulation 18 is in fluid communication with the interior of the lamp 10 through the exhaust tubulation opening 48, and further through a shallow recess 64 in the upper surface 42 of the base 14. The recess 64, in turn, is in fluid communication with the interior of the lamp through the anode opening 38 which is slightly larger in diameter than then anode 16.

In the improved assembly process, there are only two brazing processes and one welding process for assembly of the lamp 10. This constitutes an improvement over the prior art processes which included up to four or five separate brazing operations and two welding operations. More specifically, in the prior art, the discrete cathode support arms had to be brazed to the window frame in a separate process, and the cathode brazed to the support arms in yet another process. In addition, the two separate body frame rings (window and base) were brazed to the body in one operation while the anode and exhaust tubulation were attached to the base in another brazing operation. Then the base and the window frame were attached to the body by welding, which requires two welding processes.

Figure 6:
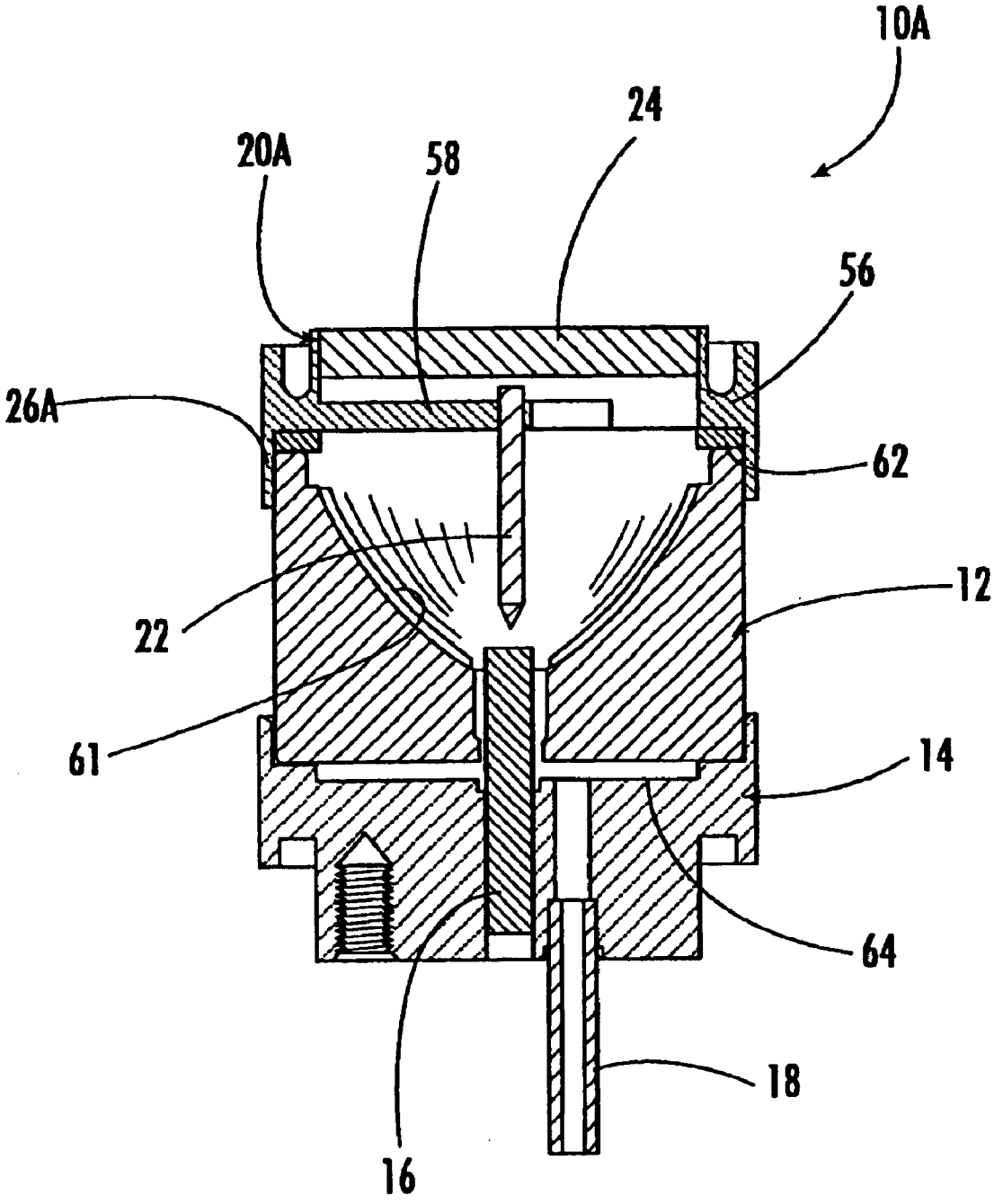
FIG. 6 is a cross-sectional view of the short arc lamp showing an alternative formation of the window ring with the window frame ring.

Turning now to FIG. 6, an alternate embodiment of the improved short arc lamp is generally indicated at 10A. This embodiment is identical to the prior embodiment 10 with the exception of having the window ring 26A integrally formed as part of the window frame 20A. This embodiment further simplifies and reduces the number of assembly components by eliminating the separate exterior window frame ring 26. However, integral formation of the window ring 26A creates an issue with regard to application of the reflective coating on the reflector surface and attachment of the window frame 20 to the body 12 since this reflective coating cannot be subject to the high brazing temperatures without special processing and/or atmospheric conditions. The window frame ring 26 is normally attached to the body 12 by brazing, and the window frame 20 attached to the ring 26 by welding. As would be obvious to one skilled in the art, one cannot braze the window frame 20 to the body 12 in this configuration without first applying the reflective coating. However, it is extremely difficult and expensive to protect the reflective coating during the brazing of the window frame to the body. Although a viable alternative, there are still processing considerations to address. It has been determined that one option would be to braze a separate welding ring in a recessed shoulder around the top edge of the body. However, this results in the same number of process steps and components parts as in the preferred embodiment with the added complexity of protecting the reflective coating.

As indicated in the background hereinabove, another significant issue in the construction of short arc lamps, is the thermal performance of the lamp, i.e. the ability of the lamp to dissipate or conduct heat generated from the arc outwardly to the outer surfaces of the housing where it can be conducted away using airflow. As noted in the background, much of the cited prior art attempts to deal with heat transfer by modification of the body structure and the addition of metal heat spreader components. The applicant seeks to improve the thermal performance of the lamp by modifying the transfer of IR energy emitted by the lamp.

In a second preferred embodiment of the invention which is adapted for superior thermal performance, the ceramic body 12 is fashioned from beryllium oxide (beryllia) rather than alumina. Beryllium oxide is an exotic ceramic material that, in contrast to alumina, has exceptional thermal transfer characteristics. More specifically, beryllium oxide has a thermal conductivity of approximately 250W/mK at 25° C. whereas alumina has a thermal conductivity of approximately 16–30 W/mK at 25° C. (depending on purity), representing up to a 15 times increase in performance. The disadvantages to beryllium oxide are cost and availability. Beryllium oxide is far more expensive than alumina and is not as readily available, and to the knowledge of the applicant has never been considered for use in this type of application by others in this area. Hence the focused on mechanical means of heat transfer in the prior art.

However, the Applicant believes that the complexity of the prior art solutions to heat transfer, such as the use of heat sink fins on the external surface of the lamp, or the machining of convex spaces behind the reflective surface combined with the use of heat spreading plates have created materials and processing cost increases that are not in proportion to the benefit gained. Accordingly, the Applicant has sought alternative means for extracting heat from the lamp.

Figure 11:
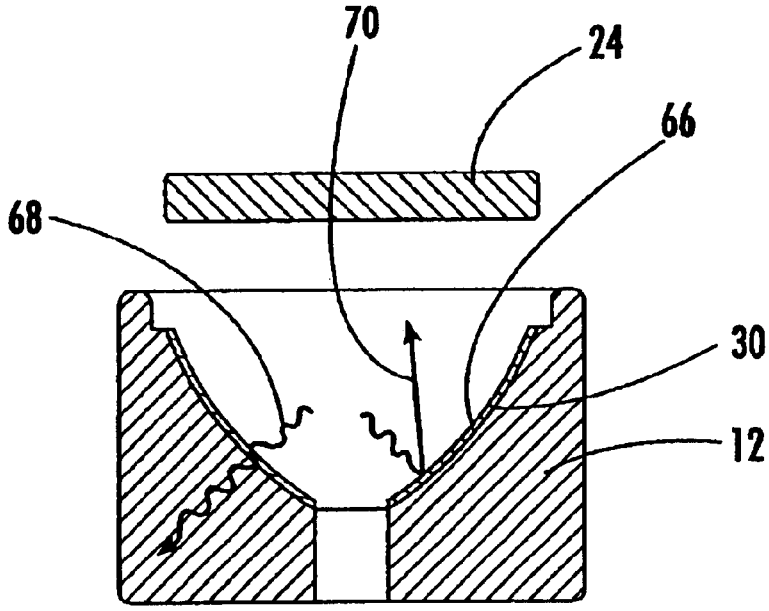
FIG. 11 is a cross-sectional view showing the arrangement of an IR pass through coating.

Coupled with the provision of a beryllium oxide body, the alternative embodiment is further provided with a novel coating 66 which helps keep infra-red (IR) light energy 68 from escaping outwardly through the window of the lamp where such energy is difficult to manage (FIG. 11). As is known to those skilled in the art, lamps of type contemplated herein are mounted into receptacles that include heat sink devices that typically clamp around the window frame ring 26 and base 14, and/or come in direct contact with the rear of the base 14 using mounting holes 50. Fans force air over the heat sink fins to dissipate the heat. Accordingly, IR energy 68 that escapes through the front window of the lamp is not absorbed by the heat sinks and cannot be controlled by the receptacle. In the preferred embodiment of the improved thermally modified lamps, the reflector surface of the beryllium oxide body is provided with a multi-layer dichroic coating 66 which functions to reflect all visible light 70 outwardly through the window, while allowing IR light energy 68 to pass through the coating 66. Accordingly, the IR energy 68 immediately passes through the coating 66 into the body 12 and is conducted outwardly through the body 12 and the base 14 where it can be more effectively managed by the heat sinks.

Figure 11A:
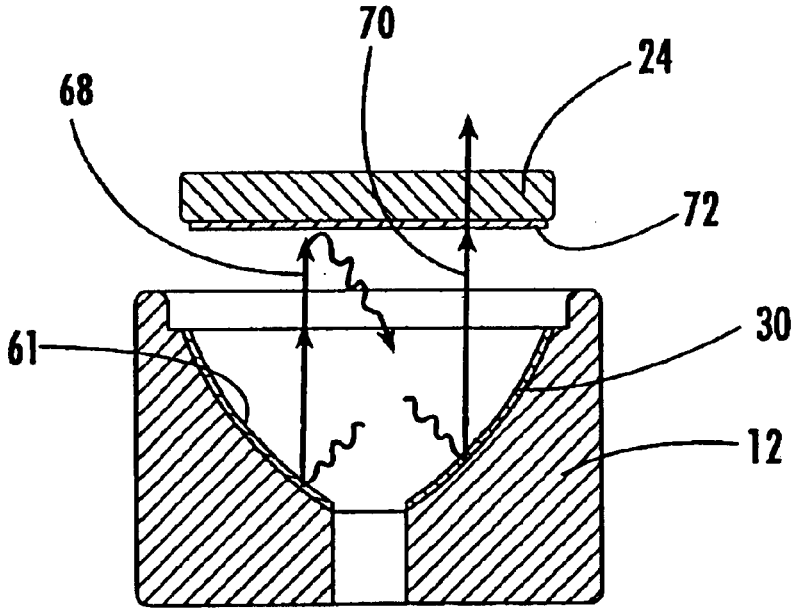
FIG. 11A is yet another cross-sectional view showing arrangement of an IR reflective coating.

In another instance (See FIG. 11A), an IR reflective coating 72 is placed on the sapphire window 24 of the lamp to reflect IR light energy back into the interior of the lamp 10 where it can then be absorbed by the body 12 and conducted outwardly through the body 12 and base 14 for dissipation by the cooling arrangement of the device in which the lamp is utilized. IR reflective coatings 72 are well known in the optical arts and are available from a variety of different coating service providers. In most cases, such coatings are proprietary formulations custom designed for a particular application depending on output characteristics as specified by the customer. In this arrangement, the coating may be applied on either the interior surface of the window, or the exterior surface of the window. In still another instance, wavelength selective coatings 61 and 72 are applied to both the reflector surface and the window. By incorporating the IR coating on the lamp itself, it dramatically simplifies the management of IR energy that was otherwise done with external components. Filters and mirrors are no longer needed, thus decreasing optical alignment and output losses through such devices.

In all instances, the ability of the lamp 10 to more efficiently conduct heat has two possible benefits. The first possible benefit of improved heat transfer is that it allows the lamp to be operated at a higher wattage, i.e. increased light output from a smaller light source without sacrificing the normal life expectancy of the lamp. Under normal circumstances, operating the lamp at an increased wattage will significantly reduce the life expectancy of the lamp. The second possible benefit is an extended life expectancy of the lamp when operated at normal wattage levels, as currently used in the art. Better thermal performance will maintain the lamps at a cooler temperature, decrease degradation of the components due to thermally induced stresses, and thus improve the life expectancy of the lamp. The owner/operator will not have to replace the lamp as often.

Figure 11B:
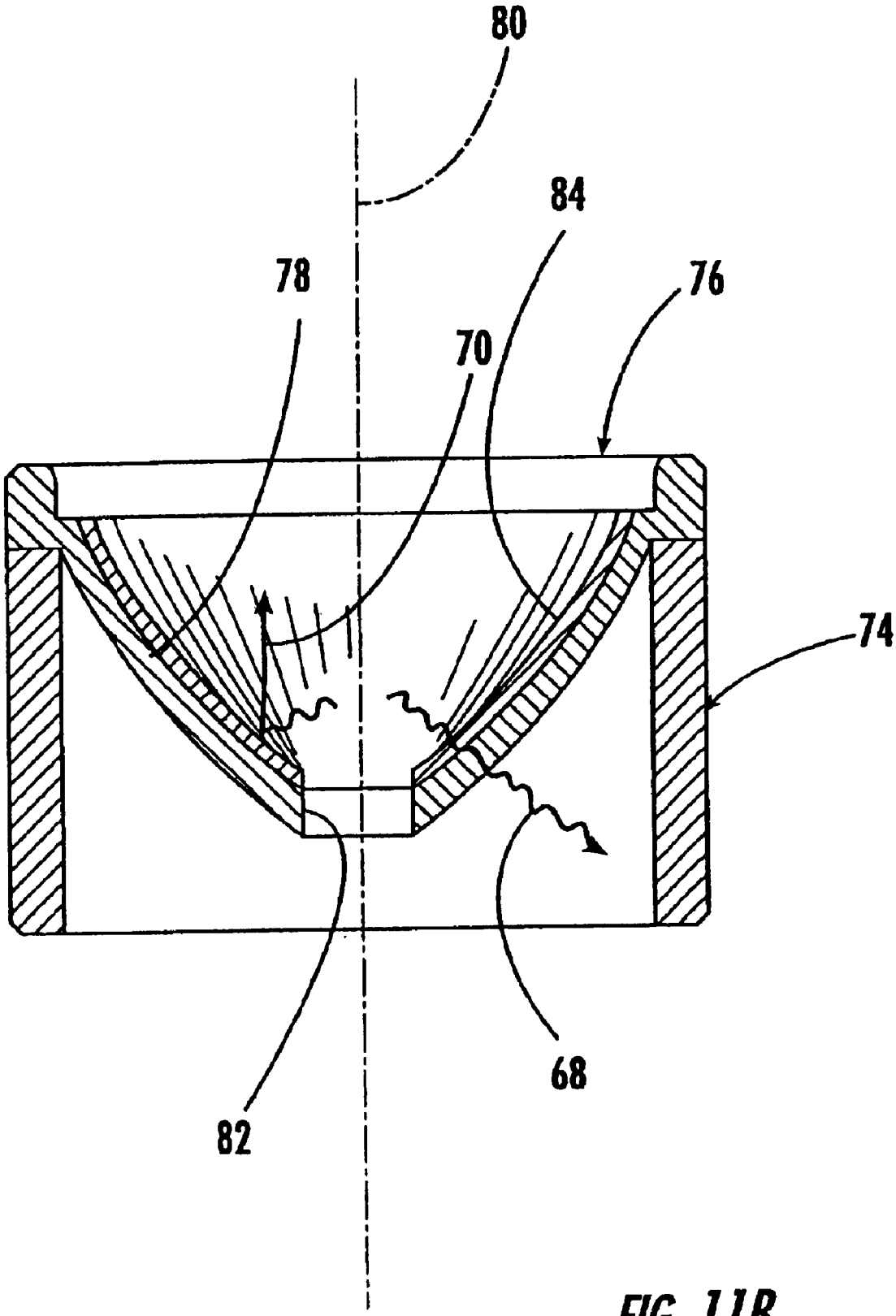
FIG. 11B is a cross-sectional view of an alternative embodiment of the body of the short arc lamp.

In yet another embodiment (see FIG. 11B) modified for thermal performance, the one piece ceramic body 12 is replaced by a cylindrical tubular ceramic sleeve 74 and concave glass reflector insert 76. The tubular sleeve 74 has the same outer diameter as the conventional body 12 and can be formed from either alumina or beryllium oxide as desired. As described above, the beryllium oxide will provide superior heat transfer. The concave reflector insert 76 mimics the same reflector shape as the reflector surface 30 in the above noted ceramic body. Similarly, it includes a reflector surface 78 having a central axis of rotation 80 and an axial opening 82 for receiving the anode therethrough. The glass reflector insert 76 is provided with a dichroic coating 84, which, as indicated above, reflects visible light 70 outwardly through the sapphire window (not shown), and allows IR energy to pass through the reflector surface 78. IR energy 68 is transferred to the tubular sleeve 74 and conducted to the outside surfaces of the sleeve 74 more readily than in a solid alumina or solid beryllium oxide body construction.

Accordingly, among the objects of the instant invention are: the provision of an improved short arc lamp having a simplified construction of the window support, the base and the body; the provision of a window support of a single piece construction that supports the cathode, supports the window, provides thermal conduction of the cathode and provides electrical conduction to the cathode; the provision of a base that can be sealed to the anode, the reflector body, and to the exhaust tubulation in a single brazing operation; the provision of a base that increases the surface area of the base without altering the current footprint and that also increases thermal conduction to the external surface; the provision of an improved short arc lamp wherein the ceramic reflector body is fabricated from beryllium oxide to improve thermal conduction of heat from the lamp to the external surfaces; and the provision of an improved short arc lamp wherein the window is provided with an infra-red coating to reflect IR energy back into the lamp, or the reflector surface is provided with a dichroic IR pass-through coating.

It can therefore be seen that the integral formation of the cathode support arms with the annular flange of the window frame and the integral formation of the base shoulder ring with the base significantly simplifies assembly and manufacturing by eliminating at least 2–3 brazing steps in the assembly process. In addition, it can be seen that the combined use of beryllium oxide as an improved material for thermal conduction combined with the use of an IR reflective coating on the window significantly improves and simplifies the thermal performance of the arc lamp allowing the lamp to have an extended operating life and/or allowing the lamp to be operated at higher power levels. For these reasons, the instant invention is believed to represent a significant advancement in the art which has substantial commercial merit.

What is claimed:

1. A short arc lamp comprising:

a ceramic body having a first end in which a concave reflector surface is formed, said reflector surface having an axis of rotation and a focal region defined along said axis of rotation, said ceramic body having an opposing second end, said ceramic body being formed from beryllium oxide;

a base including a main body portion having a first end and a second end, said first end having a recess therein adapted to concentrically receive a second end of said ceramic body, said second end having surface area enhancements formed therein;

a window frame structure positioned in abutting concentric relation with said first end of said ceramic body, said window frame structure including an annular flange having a substantially U-shaped cross-section and further including at least one cathode support arm extending radially inwardly therefrom, said cathode support arm supporting a cathode mount at the terminal end thereof and being positioned on said axis of rotation;

a window frame ring extending in overlapping relation across the abutting ends of said window frame and said first end of said ceramic body;

a disk-shaped window seated within said window frame;

an anode mounted in said base and including a tip portion that extends through said ceramic body, said tip portion extending in axial alignment with said axis of rotation of said reflector surface and being positioned within said focal region;

a cathode secured within said cathode mount and extending axially along said axis of rotation, said cathode having a tip portion in axially spaced relation to said tip portion of said anode; and means for redirecting substantially all of the infra-red light energy generated by said lamp, said means including a dichroic coating on said reflector surface, said dichroic coating reflecting visible light outwardly toward said window, said coating further allowing infra-red energy to pass through said coating and a filter coating on said window preventing infra-red light energy from exiting said lamp through said window, said infra-red energy being transmitted as heat through said reflector surface and said body, into said base, said infra-red energy being dissipated through said surface area enhancements.

* * * * *